US005154522A

United States Patent [19]

Nobilec

[11] Patent Number: 5,154,522

[45] Date of Patent: Oct. 13, 1992

[54] SKI WAX APPLICATOR

[76] Inventor: Leslaw Nobilec, 544 Tennyson Ave., Syracuse, N.Y. 13204

[21] Appl. No.: 594,553

[22] Filed: Oct. 9, 1990

[51] Int. Cl.[5] ..... A63C 11/08; A47L 13/32; B05C 17/00

[52] U.S. Cl. ..... 401/1; 401/2; 401/199; 401/205

[58] Field of Search ..... 401/1, 2, 205, 199

[56] References Cited

U.S. PATENT DOCUMENTS

| | | | |
|---|---|---|---|
| 850,814 | 4/1907 | Burdett | 401/199 |
| 1,328,769 | 1/1920 | Spencer | 401/1 |
| 1,394,662 | 10/1921 | Blomquist | 401/1 |
| 1,786,723 | 12/1930 | Stein | 401/199 |
| 1,969,036 | 8/1934 | Riebel, Jr. | 401/2 |
| 2,100,855 | 11/1937 | Kelly | 401/205 |
| 2,118,415 | 5/1938 | Pesark | 401/1 |
| 3,950,105 | 4/1976 | Moss et al. | 401/1 |
| 3,988,070 | 10/1976 | Tobler et al. | 401/2 |
| 4,065,214 | 12/1977 | Daum et al. | 401/2 |
| 4,118,130 | 10/1978 | Kasabke et al. | 401/2 |
| 4,889,440 | 12/1989 | Shano | 401/1 |

FOREIGN PATENT DOCUMENTS

| | | | |
|---|---|---|---|
| 2549376 | 9/1977 | Fed. Rep. of Germany | 401/1 |
| 2638548 | 9/1977 | Fed. Rep. of Germany | 401/1 |
| 250859 | 7/1941 | Switzerland | 401/1 |

*Primary Examiner*—Steven A. Bratlie
*Attorney, Agent, or Firm*—Katherine McGuire

[57] ABSTRACT

A ski wax applicator for applying melted wax to the running surface of a ski comprises a housing including proximal and distal handle portions for manually manipulating the device over the ski running surfacae. Within the housing a wax container is removably provided into which wax may be deposited and melted via an internal heating element. The melted wax travels from holes in the bottom of the container at a controlled rate through a plurality of linearly spaced, wax permeable wicks positioned colinearly within heat conductive pipes or conduits. These small wicks extend into linearly spaced bores in a large wick which is removably positioned at the bottom of the housing for engagement with the ski surface, extending laterally across the full width of the ski. A pair of spring loaded, rectilinear bars are located, one on each side of and parallel to the large wick. As the device is drawn in one direction along the ski surface, the proximal bar heats the ski surface to increase the porosity thereof. The melted wax is then deposited by the large wick, followed by a smoothing and polishing by the heated distal bar. Only one stroke of the device over the ski surface is necessary.

16 Claims, 5 Drawing Sheets

SKI WAX APPLICATOR

BACKGROUND OF THE INVENTION

This invention relates to apparatus for applying melted wax to the bottom surface of a ski and, more particularly, to such apparatus which includes a combination of novel elements for improved wax delivery, deeper penetration of the wax into the pores of the ski surface, and a smoother finish of the wax layer upon the ski surface than has been achievable with like apparatus heretofore available.

It is the usual practice of skiers to apply a wax to the bottom surface of the skis for improved glidability of the skis over the snow, in addition to provide protection to the bottom surface of the ski from damage caused by scratches and nicks incurred through use. It has been found that wax which has been first heated and melted adheres itself better to the ski surface than an application of cold, hard wax. It has also been found that the deeper the penetration of the wax into the ski surface, the better the wax maintains its adhesion and integrity throughout extended periods of use of the skis. Accordingly, the ideal apparatus would successfully deposit melted wax onto the bottom surface of a ski by deeply penetrating the surface material (typically plastic), while leaving the resultant surface of deposited wax smoothly polished to reduce friction between the ski and snow surface. Attempts at such apparatus may be seen in U.S. Pat. No. 4,407,218, issued to Ordas on Oct. 4, 1983; U.S. Pat. No. 3,912,902, issued to Herniter on Jul. 12, 1974; U.S. Pat. No. 4,029,046, issued to Hertel on Jun. 14, 1977; and U.S. Pat. No. 4,334,793, issued to Thompson on Jun. 15, 1982.

A brief perusal of the above-listed patents reveal that the Hertel and Ordas patents involve inefficient, roller-type wax applicators which do not permit substantial friction between the wax applicator and the ski surfaces, as is desirable for a deeper penetration of the wax into the ski surface. The Herniter patent involves a simple housed heating element manually moveable upon rollers for passage over cold wax which had previously been manually applied to the bottom surface of the ski. After the wax has been heated to a slight boil, the wax is wiped to a smooth finish, this process being repeated as many times as necessary to achieve the desired results, which may or may not occur. The more relevant Thompson patent discloses a ski wax applicator for applying wax, which has been heated and melted in a well 52, to the bottom surface of a ski. Pressure exerted upon valve elements 96 by manually drawing the apparatus against the ski surface allows two spaced lines of wax to be deposited upon either side of the center line of the ski surface (col. 5, lines 44–49). To spread the wax over the entire surface of the ski, one manually draws the apparatus in the opposite direction across the ski surface with the bottom wall 34 of the apparatus pressed against the ski surface. It is evident that the Thompson apparatus is inefficient at applying melted wax to a ski surface in that two movements of the apparatus over the ski surface are needed to apply a single layer of wax to the ski surface. It is also undesirable to have two spaced lines of melted wax deposited on the ski since it is very difficult to obtain an even layer of wax upon the ski surface thereafter simply by applying the bottom wall 34 against the ski surface while drawing the apparatus in the opposite direction along the ski. This is true since the wax almost immediately begins to coagulate upon the surface of the ski upon exposure to the ambient air. Furthermore, the Thompson apparatus fails to penetrate the wax deeply into the ski surface as is desired for obtaining optimal adhesion of the wax upon the ski surface.

It is therefore a main object of the present invention to provide apparatus which melts ski wax and deposits the melted wax upon the ski surface in a simple, one stroke, manual application of the apparatus along the ski surface.

It is a further object of the present invention to provide a ski wax applicator which effectively opens the pores of the surface of the ski to be treated immediately prior to deposition of melted wax thereon such that the melted wax deeply penetrates the ski surface material for enhanced adhesion of the wax thereto.

It is another object of the present invention to provide a ski wax applicator which is superior at evenly distributing a layer of melted wax over the bottom surface of a ski.

It is still another object of the present invention to provide a ski wax applicator in which a frictional force may be manually applied and manipulated by the user of the apparatus simultaneous to controlled deposition of the melted wax upon the ski surface thereby achieving enhanced penetration of the wax into the ski surface while at the same time achieving a uniform, polished layer of wax upon the ski surface.

Other objects will in part be obvious and in part appear hereinafter.

SUMMARY OF THE INVENTION

In accordance with the foregoing objects, the present invention comprises a hand held ski wax applicator for applying melted wax to the bottom surface of a ski. Pieces of hard wax are deposited into a container which is movably positioned within the main housing of the apparatus for melting of the wax therein via an incorporated electrical heat source, the temperature of which may be manually regulated. A plurality of small pipes or conduits having elongated, wax permeable wicks extending co-linearly therethrough extend from the bottom of the wax container. The ends of the wicks opposite the ends communicating with the inside of the wax container extend into a larger, elongated, wax permeable wick, the large wick extending perpendicularly to the plurality of small wicks. The side of the large wick opposite the side the plurality of small wicks extend into is exposed at the bottom of the housing for engagement with the bottom surface of a ski the large wick extending laterally across the full width of the ski. Wax which has been first heated and melted in the wax container is absorbed by and travels through the plurality of small wicks by passing through the conduits at the bottom of the container. The wax proceeds to be absorbed into the large wick which is then simultaneously pressed upon and drawn along the surface of the ski through manual manipulation of the housing which causes wax to deposit upon the bottom surface of the ski in a uniform, even layer. The amount of wax which is allowed to be absorbed by the small wicks may be regulated by manually controlled air vents located at the top of the wax container.

Parallel to and located on either side of the large wick are a pair of elongated, heat conductive, rectilinear bars which may be urged vertically toward the interior of the housing about the stationary large wick via a pair of springs located internally of the housing at each end of each bar. The bars are heated by an internal heating element provided electricity from an outside source. The flat bottom surface of the bars are exposed at the bottom of the housing such that they engage the bottom surface of the skis along with the respectively centrally located large wick as mentioned above when the apparatus is drawn along the bottom surface of the ski in the intended manner, with the large wick and bars extending laterally across the ski from one edge of the ski to the other.

To operate, the user manually grasps the rearwardly projecting handle of the housing with one hand and applies a downward force with the other hand at a forwardly projecting portion of the housing with the bottom face of the bars and large wick engaging the ski surface in the orientation described above. The apparatus is drawn along the ski bottom surface, in the preferred direction from ski tip to ski back, by pulling on the rearward handle while the user simultaneously applies the desired amount of pressure downwardly upon the forward handle. The resultant upward reactant force of the ski bottom surface upon the bottom or engaged surface of the bars cause the bars to move vertically upward toward the interior of the housing which causes the large wick to engage the ski surface with more friction and deposit wax contained therein upon the ski surface in a uniform manner. The more pressure applied upon the forward handle, the more friction is created between the wick and ski surface which allows for deeper penetration of the wax into the ski surface.

Another important aspect of the operation of the invention is the orientation of the bars about the large wick. As the user draws the apparatus along the ski surface by pulling the rearward handle of the housing as described above, the bar which is located nearest the rear handle is the first element to engage the ski surface. Since the bars are heat conductive as aforementioned, the heat from that bar conductively heats the ski surface which opens the pores of the ski surface material immediately prior to deposition of the wax which flows from the large wick and which successively engages the ski surface as the apparatus is drawn therealong as described above. The wax thereby penetrates deep into the pores of the ski surface which is highly desirable for enhanced ski surface-wax adhesion.

The bar closest the forward handle of the housing is the third element to engage the surface of the ski as the housing is drawn therealong as described above. The heat conducted to the newly waxed surface of the ski by this bar causes even deeper penetration of the wax into the pores while it also smooths and polishes the surface of the wax. It is therefore noted that only one passage of the present ski wax applicator over the ski bottom surface is needed to achieve a wax coating which deeply penetrates the pores of the ski surface in addition to providing a smooth, polished, wax surface which provides for optimal ski running surface condition for the snow.

DETAILED DESCRIPTION

Figure 5:
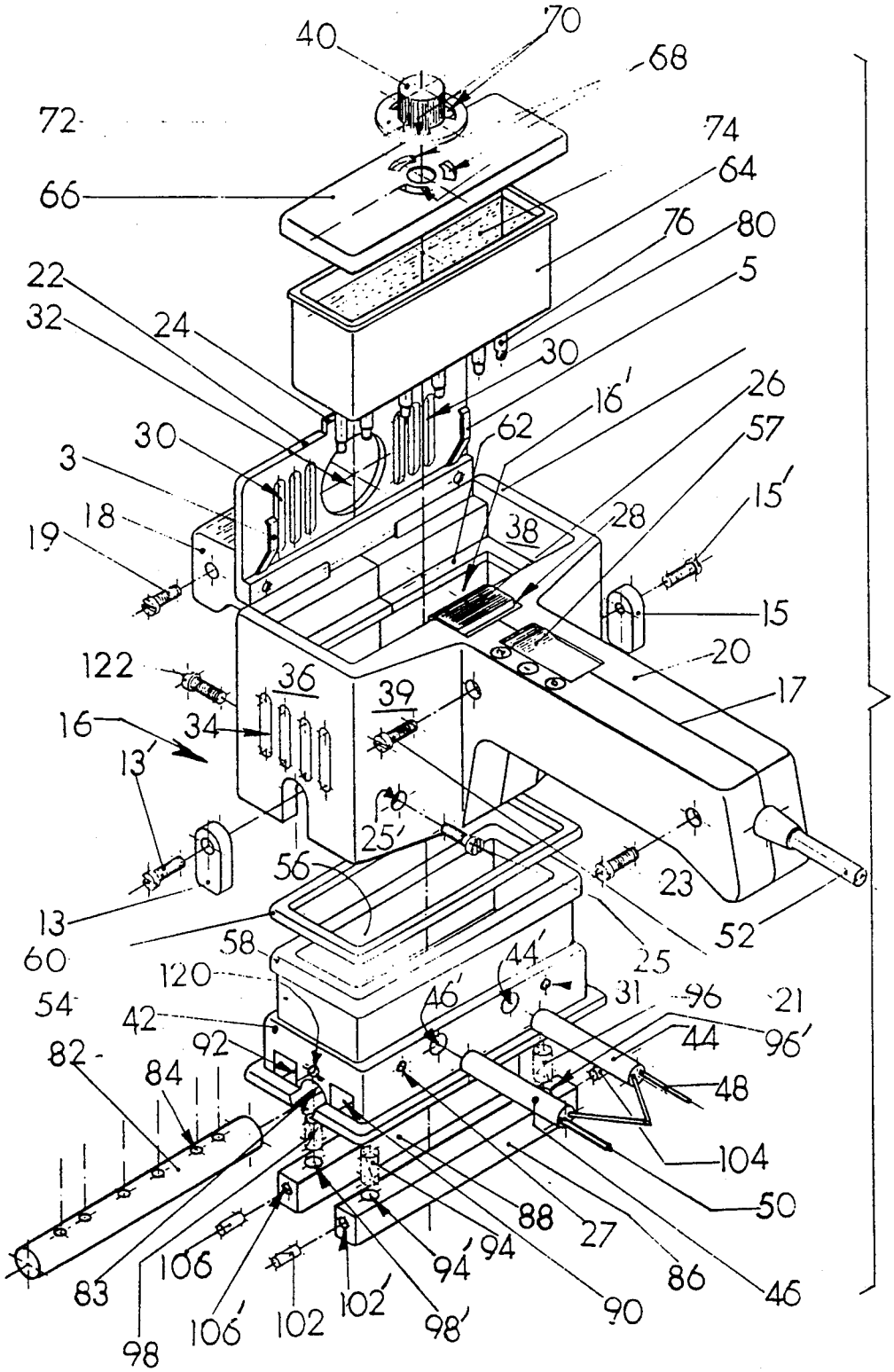
FIG. 5 is an exploded, perspective view of the apparatus.

Referring now to the drawings, there is seen in the various Figures a ski wax applicator denoted generally by the reference numeral 10 having portions to be described for engagement with the bottom or running surface 12 of a conventional snow ski 14. Ski wax applicator 10 is used for applying melted wax to the running surface of a ski and includes a housing 16 which is formed of any rigid material with a low heat conductivity such as any of a variety of resin plastics. Housing 16 is molded or otherwise formed into two symmetrical halves as evidenced by line 17 where the two halves meet (FIGS. 3 and 5) when attached together by respective front, middle and rear securing bolts 19, 21 and 23. Housing 16 is seen to include an integral, forwardly projecting, distal handle 18 and a rearwardly projecting proximal handle 20, the respective purposes of which are to provide support for simultaneously manually exerting pressure down upon, and pulling the applicator 10 longitudinally in one direction along the running surface 12 of a ski 14, as will be described more fully below.

Figure 1:
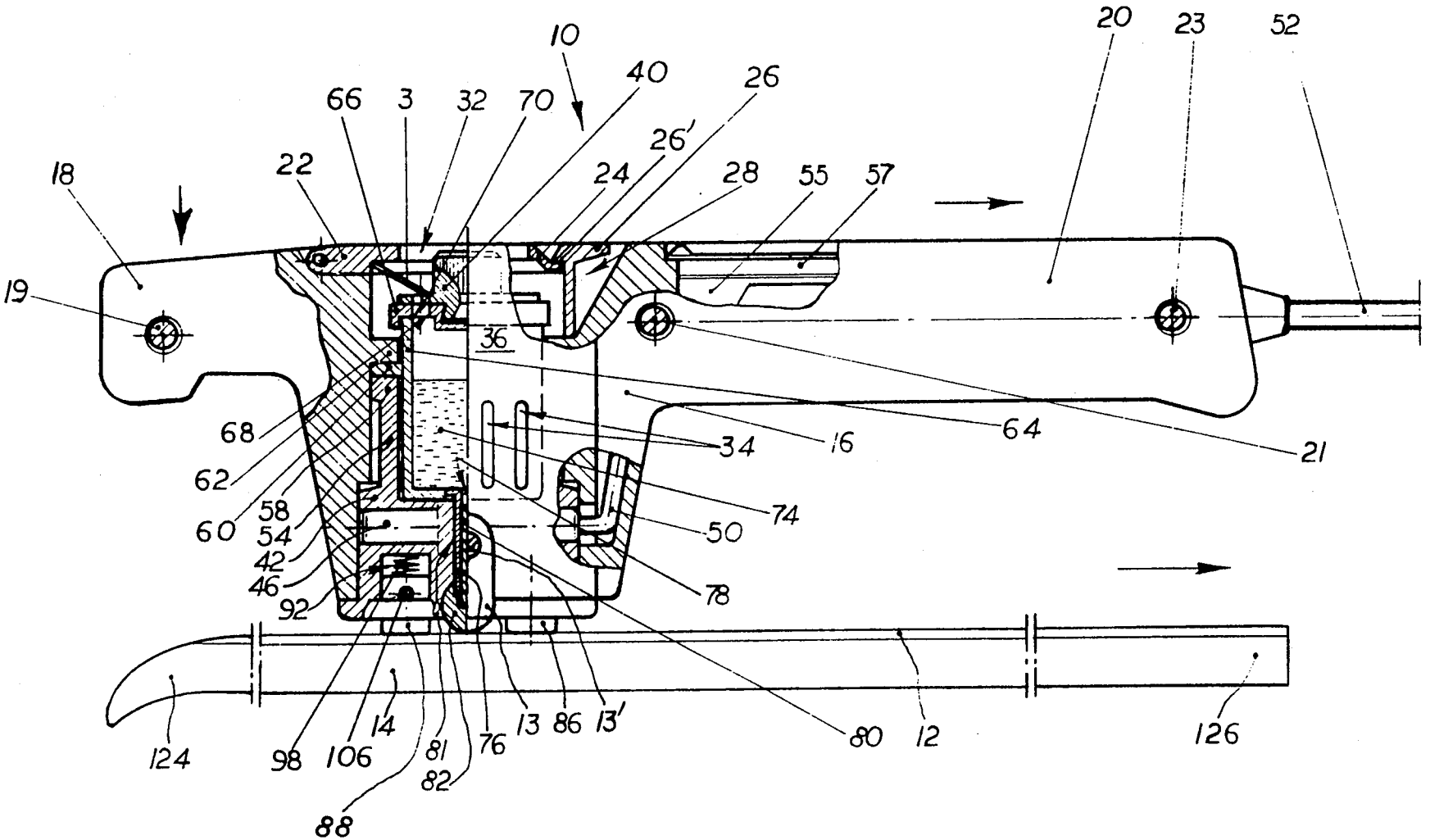
FIG. 1 is a side, elevational view of the apparatus with portions broken away to reveal internal components thereof.

Housing 16 includes a hingedly mounted top cover 22 to provide access to the internal elements of the housing to be described. Releasable cover closing means are provided in the form of a cover lip 24 and a cover latch 26. To securely close the cover 22 upon housing 16, the user manually closes cover 22 and presses lip 24 against latch 26. The pressure exerted upon latch 26 urges it to move toward rear handle 20 within recess 28 until lip 24 "snap fits" beneath the forward flange 26' of latch 26 (FIG. 1). Releasing lip 24 from latch 26 to open cover 22 requires pressure upon latch 26 in the direction toward rear handle 20 (typically with the thumb) such that latch 26 moves rearwardly within recess 28 until lip 24 clears forward flange 26' thereby allowing cover 22 to be lifted to reveal the inside of housing 16.

Figure 3:
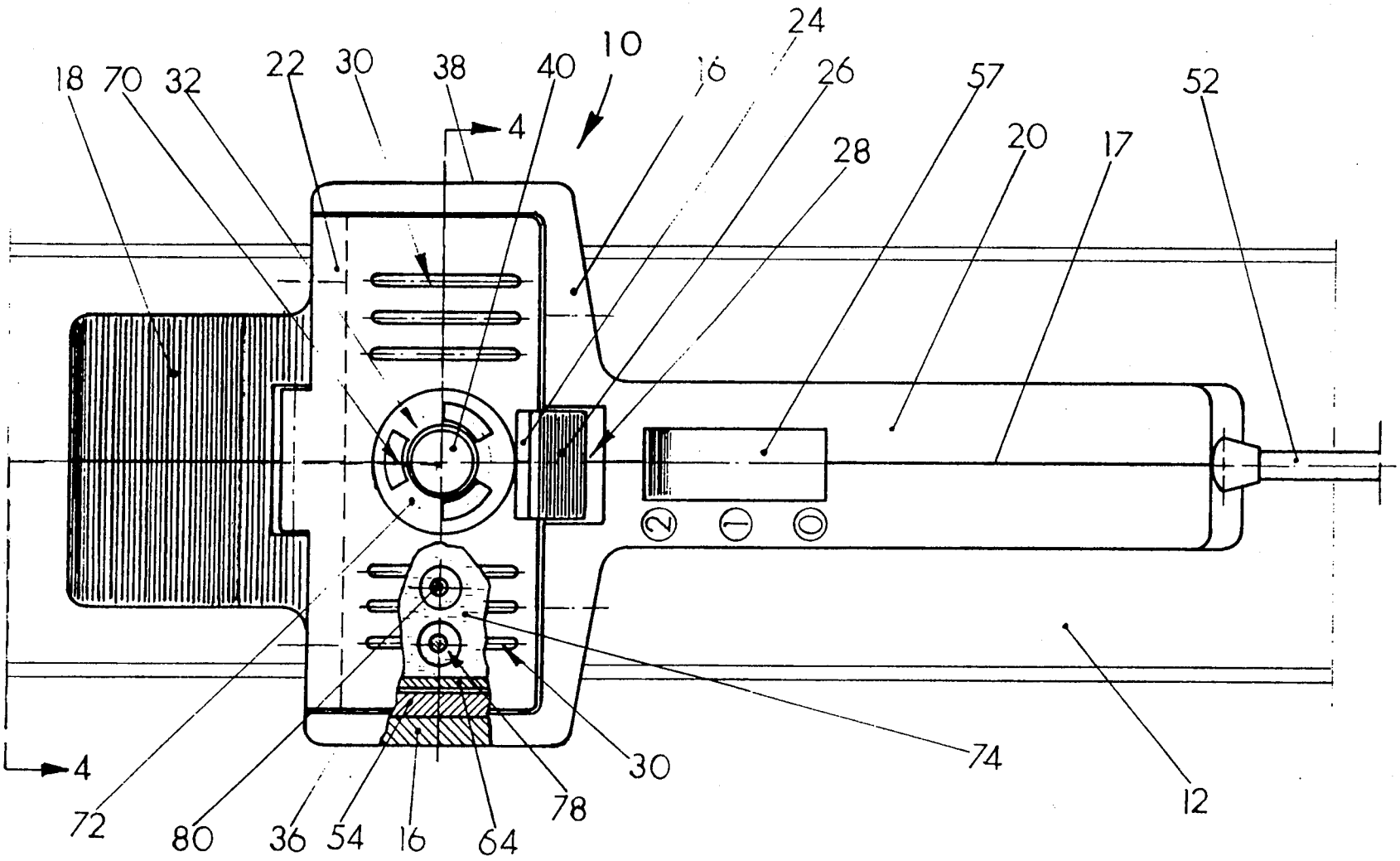
FIG. 3 is a top plan view of the apparatus.

It will be noticed that cover 22 includes a plurality of elongated, parallel spaced slots 30 located on either side of a circular orifice 32 communicating with the internal cavity of housing 16 (FIG. 3). Since thermal heating of the wax takes place internally of the housing as will be described below, slots 30 serve the purpose of vents to allow excess heat to escape the internal cavity of housing 16 therethrough. In this respect, like elongated, parallel slots 34 are provided for the same purpose on either side wall 36 and 38 of housing 16 (slots 34 not shown on side 38 in FIG. 5).

Circular orifice 32 is provided to permit access to the wax flow regulator knob 40 when cover 22 is in the closed position as will be more fully understood below.

Turning attention now to the internal elements of housing 16, and respective placement and orientation of each therein, a heat conductive manifold 42 is provided for conductively transferring heat to certain other components held within housing cavity 16' to be described. Two elongated resistance heaters 44 and 46 extend parallel to each other laterally through respective orifices 44' and 46' in manifold 42, heaters 44 and 46 being strategically located at equal distances between each other and between the short ends of the manifold running parallel to heaters 44 and 46 such that a more even distribution of heat to manifold 42 takes place. Heaters 44 and 46 are supplied electricity via respective electric wires 48 and 50 which connect to electrical cord 52, cord 52 extending through rear handle 20 to connect to an outside electrical source such as a conventional 110–120 V AC outlet, for example. Thermoregulator 55 (FIG. 1) may be regulated by slide switch 57 located on the top of rear handle 20 for easy access. The level of electricity provided to heat heaters 44 and 46 may therefore be varied from a high temperature (numeral 2 printed on handle 20) to a low temperature setting (numeral 1) numeral 0 turning the heaters off, as needed according to the type of wax used therewith.

Formed integral with manifold 42 are upwardly extending walls 54 having an open top forming a rectilinear well 56. Walls 54 include coping 58, the outer edge of which engages the interior wall of housing interior cavity 16' when placed therein (FIG. 1), the top surface of coping 58 being provided with a gasket 60 which is positioned between it and internal flange 62 of housing 16 to create an air-tight seal between the upwardly extending walls 54 of manifold 42 and the wax container 64.

Wax container 64 includes an air-tight, releasable covering cap 66 having annularly spaced, arcuate slots 68 for alignment with like slots 70 formed about outwardly extending, annular flange 72 of knob 40. By manually turning knob 40, which is rotatably attached to cover 66 by known means, the degree of alignment between slots 68 and 70 may be varied from a completely open position wherein slots 68 and 70 are in near-perfect alignment, to a completely closed position wherein slots 68 and 70 have no alignment such that no air may enter container 64. The more air allowed to enter container 64 through slots 68 and 70, the more melted wax may flow from the orifices 78 located at the bottom wall of container 64. Specifically, a plurality of linearly spaced pipes or conduits 76 extend downwardly parallel to each other from an equal number of orifices 78 located at the bottom wall of container 64. A plurality of small, elongate wicks 80 extend colinearly through conduits 76 from a point immediately below orifices 78, to a point extended from the free ends of conduits 76 as seen most clearly in FIG. 4.

A large, wax permeable wick 82 colinearly extends within an elongate channel 83 traversing the bottom of manifold 42, perpendicular to heaters 44 and 46 and substantially midway between the opposite, long edges of manifold 42. Wick securing pieces 13 and 15 are removeably attached to respective housing side walls 36 and 38 by bolts 13' and 15' engaging respective manifold threaded bores 120 and 122 (bore 122 not shown). The pieces 13 and 15 act to maintain the position of wick 82 within channel 83 and are removeable if replacement of wick 82 is desired. Wick 82 is seen to include bore holes 84 linearly spaced along substantially the full 80, which pass through respectively positioned manifold through holes 81, when container 64 is lowered into internal cavity 16' of housing 16 and manifold 42 is positioned within housing 16 with coping 58 and gasket 60 bearing up against internal housing flange 62. Manifold 42 and elements supported thereby are secured to housing 16 by a plurality of securing bolts passing therethrough, one such bolt 25 being shown in FIG. 5 to pass through hole 25' located on the rear wall 39 of housing 16 to secure into threaded bolt hole 27 on manifold 42. Another bolt located on the opposite side of rear handle 20 (not shown) is provided to pass through housing 16 and threadedly engage hole 31 located on manifold 42. Likewise, bolt 122 passes through front wall 41 as well as another bolt (not shown) on the opposite side of forward handle 18 to secure manifold 42 in position inside housing 16.

The exposed ends of small wicks 80 insert into respectively aligned bore holes 84 in large wick 82 in the fully assembled condition of the apparatus. More specifically, spring elements 3 and 5 mounted on the inside of cover 22 bear against wax container cover 66 when housing cover 22 is closed such that the downward force acts to fully engage conduits 76 and respective wicks 80 into bore holes 84 of wick 82 to complete the passageway for the melted wax 74 to enter wick 82 and flow therefrom. Heaters 44 and 46 conductively heat manifold 42 and integral walls 54 thereof, which in turn conductively heat container 64 and wick conduits 76. Wax which has been placed into container 64 is thereby heated into a melted, liquified wax 74 which travels through the orifices 78 at the bottom of the container to pass through the permeable wicks 80.

As aforementioned, the rate of wax flow from container 64 through orifice 78 and wicks 80 may be regulated by turning knob 40 which is accessible through orifice 32 on cover 22. Heat delivered to conduits 76 provide for a continued, steady flow of melted wax 74 through wicks 80 which in turn flows into large wick 82 which proceeds to deposit the melted wax 74 onto a ski surface 12 during operation of the invention described more fully below. The wicks 80 and 82 are made of a felt-like material which has the capacity to hold large amounts of melted wax 74. The large wick 82 maintains its absorption integrity (i.e., capillary structure) under stress from repeated compression and indentation. The wick 82 is easily replaceable also, as necessary, as is container 64 with associated wicks 80 if different types of waxes are alternately desirable.

Parallel to and located on either side of large wick 82 are elongated, rectilinear bars 86 and 88 which are constructed of a highly heat conductive metal such as aluminum, for example, receiving heat via manifold 42 which has been conductively heated by resistance heaters 44 and 46 as described above. Bars 86 and 88 are positioned within respective elongate channels 90 and 92 at the bottom of manifold 42, on either side of large wick channel 83. The respective height of channels 90 and 92 within manifold 42 are greater than the height of bars 86 and 88 such that bars 86 and 88 may move vertically up and down within respective channels 90 and 92 via spring elements 94 and 96, located in respective bore holes 94' and 96' in the top surface of bar 86, and spring elements 98 and 100, located in respective bore holes 98' and 100' in the top surface of bar 88 (spring 100 and respective bore hole 100' not shown). The top portions of the springs bear up against manifold 42 within their respective channels, while the bottom portions of the springs bear against the bottom of their respective bore holes within the bars 86 and 88 as seen clearly in FIGS. 1, 2 and 4. Bars 86 and 88 are secured within their respective channels 90 and 92 by pins 102 and 104 which extend into respective longitudinal bores 102' and 104' on either end of bar 86 (bore 104' not shown), and pins 106 and 108 which extend into respective longitudinal bores 106' and 108' on either end of bar 88. (FIGS. 4 and 5, pin 108 and respective bore 108' not shown on opposite end of bar 88). As seen clearly in FIG. 4, the end of the pin 106 extending outward from bar 88 extends into a vertically elongate slot 110 located on the inside of side wall 36 of housing 16, as do the other three pins 102, 104 and 108 into like, vertically elongate slots on the inside of opposite housing side wall 38, although these are not shown in the Figures. In this way, bars 86 and 88 may move vertically up and down within respective channels 90 and 92 with the spring action of spring members 94, 96, 98 and 100, and the sliding action of pins 102, 104, 106 and 108 within respective, vertically elongate slots 110.

Figure 2:
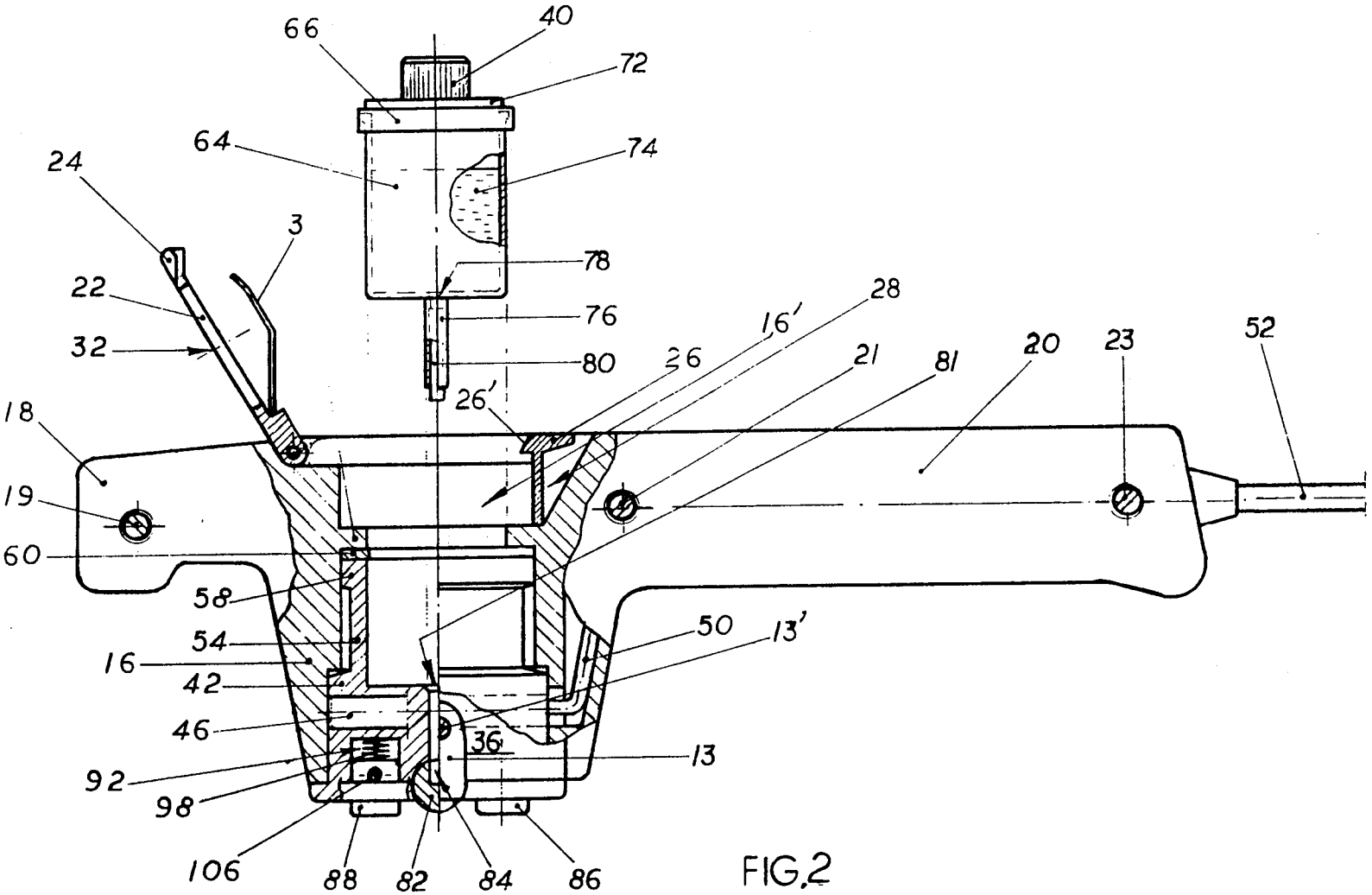
FIG. 2 is a side, elevational view of the apparatus showing the wax container and associated conduits and wicks removed and spaced therefrom, portions of the apparatus broken away to reveal internal components thereof.
Figure 4:
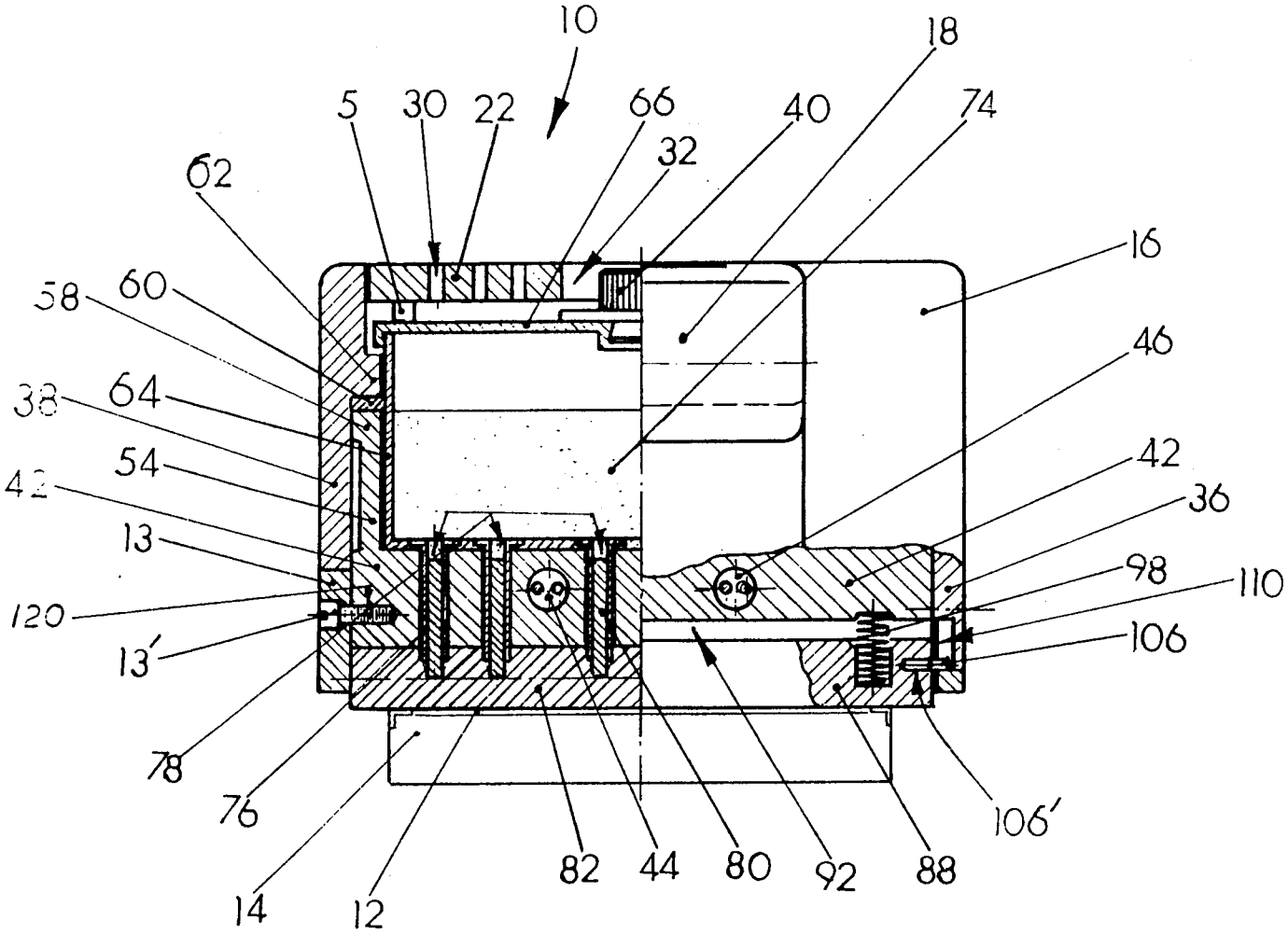
FIG. 4 is a front, elevational view of the apparatus showing the left half of the apparatus in cross-section taken generally along the line 4—4 in FIG. 3, and showing the right half of the apparatus with portions broken away to reveal internal components thereof.

Referring to FIGS. 1, 2 and 4, bars 86 and 88 are seen in their fully extended position within respective channels 90 and 92, the bottom surfaces thereof contacting ski bottom surface 12 when apparatus 10 is placed thereon in the manner shown. The tension of spring elements 94, 96, 98 and 100 are such that bars 86 and 88 remain in the fully extended position until a force acted upon the bottom surface of the bars becomes greater than the tension strength of the springs, at which time bars 86 and 88 may begin to move vertically upward within their respective channels 90 and 92. When bars 86 and 88 are in their fully extended position and apparatus 10 is laid upon a ski bottom surface 12 in the orientation shown in FIGS. 1, 3 and 4, large wick 82 extends laterally across the width of ski surface 12 to deposit melted wax flowing therefrom in accordance with the description above, to the surface 12. It is intended that the user begin the waxing procedure by laying apparatus 10 across the ski bottom surface 12 adjacent the front tip 124 of the ski, the ski first being stabilized on a rigid, horizontal surface. The front handle 18 of the housing 16 should overhang the tip 124 of the ski as seen in FIG. 1. The user manually grips the rear handle 20 with one hand and initiates pulling the apparatus toward the back end 126 of the ski while simultaneously exerting a desired amount of pressure downwardly upon forward handle 18 with the other hand. As apparatus 10 is drawn along ski surface 12 in this manner, bar 86, which has been conductively heated by heaters 44 and 46 and manifold 42, heats the ski surface 12, which is successively followed by contact with wick 82 and opposite bar 88. The initial contact of the ski surface 12 with bar 86 as apparatus 10 is drawn longitudinally along ski 14 in accordance with the above, creates open pores in the ski surface 12. Wick 82 then promptly deposits melted wax 74 upon ski surface 12 which penetrates deeply into the pores of ski surface 12 created by the heat conducted thereto by bar 86. Immediately following the deposition of melted wax 74 upon ski surface 12 by wick 82, bar 88 conductively heats the deposited wax and thereby smooths and polishes the surface thereof. The waxing process just described requires only one passage of apparatus 10 longitudinally over ski surface 12. The result is a waxed ski surface having superior penetration into the ski surface and therefore superior adhesion thereto to withstand repeated runs across a snow surface with little or no damage to the ski bottom surface.

It is noted that bars 86 and 88 may move vertically up within their respective channels 90 and 92 through increased manual pressure exerted downwardly upon front handle 18, thereby providing greater friction between the wick 82 and the ski surface 12 which provides for deeper penetration of the melted wax 74 into the ski surface 12. Increased friction (i.e., increased manual pressure upon front handle 18) is desired when the ski surface 12 is deeply scarred or nicked, in which case the wax will deeply penetrate the abrasions in the ski surface.

What is claimed is:

1. Apparatus for melting and applying wax to the running surface of a ski comprising:

a) a housing having top and bottom ends with side walls extending therebetween defining an internal cavity, said housing including a handle for manual manipulation of said housing;

b) a rigid, re-usable, heat conductive wax container having a bottom wall and open top end adapted to receive and melt a quantity of wax therein, said container and said housing being cooperatively formed whereby said container may be removably positioned in said housing internal cavity;

c) a linearly elongated, wax permeable member supported and releasably secured at opposite ends thereof to said bottom end of said housing below said wax container, said member having an exposed surface at said housing bottom end for engaging a substantially planar working surface;

d) wax conduit means extending and providing fluid communication between said wax container and said wax permeable member whereby wax melted in said wax container may flow through said conduit means and into said wax permeable member; and e) heating means positioned within said housing adjacent said wax conduit means and said wax container, said heating means providing a source of heat to melt wax in said wax container and said wax conduit means.

2. The invention according to claim 1 wherein said housing top end is open to provide access to said internal cavity and wherein said wax container includes a lid movable between open and closed positions with respect to said container, said container removably positioned within said internal cavity through said housing open top end.

3. The invention according to claim 2 wherein said wax container includes manually operable wax flow regulation means providing for manual control of the rate at which said wax permeable member receives melted wax from said wax container through said wax conduit means.

4. The invention according to claim 3 wherein said housing open top end includes a hingedly mounted cover movable between open and closed positions and including lock means to selectively secure said cover in said closed position.

5. The invention according to claim 4 wherein said housing cover includes a through hole of a first diameter and said wax flow regulation means comprises:

a) at least one opening in said wax container lid providing for passage of the ambient air therein; and b) a knob having a maximum outer diameter smaller than said first diameter and including an integral, annular flange extending radially outwardly from one end of said knob, said knob and flange rotatably mounted to said wax container lid adjacent said at least one opening with said flange positioned in covering relation to said lid and said at least one opening, said cover through hole being aligned with said knob, said knob being manually accessible through said cover through hole when said wax container is placed in said housing and said housing cover is in said closed, secured position over said housing open top end, said flange including at least one slot selectively alignable with said at least one opening in said wax container lid upon manual turning of said knob whereby variable degree of alignment between said at least one opening and said at least one slot may be achieved by turning said knob a predetermined amount whereby the higher the degree of said alignment, the more air is allowed to enter said wax container which thereby increases the rate melted wax flows from said wax container into said wax conduit means.

6. The invention according to claim 5 wherein said flange and said wax container lid include a respective plurality of annularly spaced, arcuate slots alignable with each other upon turning of said knob.

7. The invention according to claim 6 wherein said wax conduit means comprises a plurality of linearly spaced, heat conductive conduits perpendicularly and integrally extending at first ends thereof from said bottom wall of said wax container and wherein an elongated, wax permeable wick is removably positioned within each of said plurality of conduits, each of said wax permeable wicks extending a distance past second ends of said conduits opposite said first ends thereof, said wax permeable member including a plurality of linearly spaced bore holes along a surface thereof opposite said exposed surface, each of said extended ends of said wicks inserting into a respective one of said bore holes in said wax permeable member upon placement of said wax container into said housing interior.

8. The invention according to claim 7 and further comprising a rigid manifold being formed solid from a heat conductive material and configured for placement within said housing internal cavity at said housing bottom end, said manifold including a top end and bottom end with a first linear channel being formed at and traversing said manifold bottom end, and a plurality of linearly spaced through bores extending through said manifold from said top end to said first linear channel and wherethrough said heat conductive conduits extend upon placing said wax container in said housing, said wax permeable member removably positioned in said first channel with said bore holes in said permeable member aligning with and abutting said through bores in said manifold, said extended ends of said wicks engaging said bore holes in said permeable member.

9. The invention according to claim 8 wherein said manifold further includes heat conductive walls extending vertically upward from the perimeter of said manifold top end to form a heat conductive well, said manifold top end forming the bottom of said well and into which said wax container may be removably placed through said housing open top end, said heating means formed and positioned to conductively heat said manifold.

10. The invention according to claim 9 wherein said manifold further includes first and second bore holes extending between and in a direction perpendicular to said plurality of through bores, said heating means comprising first and second, elongated resistance heaters positioned for operating within said manifold first and second bore holes, respectively.

11. The invention according to claim 10 wherein said manifold further includes second and third linear channels extending parallel to and on opposite sides of said first linear channel in said manifold bottom end, and wherein said apparatus further comprises first and second heater bars positioned and spring-loaded within said second and third linear channels, respectively, said first and second heater bars including substantially planar, exposed bottom surfaces for engaging a substantially planar working surface, said heater bars conductively receiving heat from said manifold.

12. The invention according to claim 11 wherein said apparatus further comprises a manually operable temperature regulator electrically connected to said resistance heaters permitting selective control of the temperature generated thereby at predetermined increments.

13. The invention according to claim 12 wherein said housing cover and side walls include air vents integrated therein for release of excess heat from said housing internal cavity.

14. The invention according to claim 13 wherein said wax permeable member is cylindrically formed of a rigid, felt-like material.

15. The invention according to claim 14 wherein said manifold heat conductive walls include an integral coping and wherein the inside surface of said housing side walls include an encircling flange, said coupling firmly abutting said flange when said manifold is positioned in said housing internal cavity.

16. The invention according to claim 15 and further comprising a gasket fit between said flange and said coping.

* * * * *